United States Patent [19]

Dassler

[11] 4,402,145

[45] Sep. 6, 1983

[54] TREAD SOLE FOR ATHLETIC SHOE CONSISTING OF RUBBER OR ANOTHER MATERIAL HAVING RUBBER-ELASTIC PROPERTIES

[75] Inventor: Armin A. Dassler, Herzogenaurach, Fed. Rep. of Germany

[73] Assignee: PUMA-Sportschuhfabriken Rudolf Dassler KG, Herzogenaurach, Fed. Rep. of Germany

[21] Appl. No.: 296,783

[22] Filed: Aug. 27, 1981

[30] Foreign Application Priority Data

Aug. 27, 1980 [DE] Fed. Rep. of Germany ..... 3032268

[51] Int. Cl.[3] ..... A43B 13/04

[52] U.S. Cl. ..... 36/32 R; 36/129; 36/59 C

[58] Field of Search ..... 36/32 R, 114, 126, 128, 36/129; 36/28, 29, 30 R, 59 R, 59 C

[56] References Cited

U.S. PATENT DOCUMENTS

| | | | |
|---|---|---|---|
| 429,429 | 6/1890 | Eckhardt | 36/59 R |
| 4,085,527 | 4/1978 | Riggs | 36/32 R |
| 4,130,947 | 12/1978 | Denu | 36/32 R |
| 4,255,874 | 3/1981 | Sironi | 36/32 R |
| 4,327,503 | 5/1982 | Johnson | 36/32 R |

*Primary Examiner*—Werner H. Schroeder
*Assistant Examiner*—Steven N. Meyers
*Attorney, Agent, or Firm*—Antonelli, Terry & Wands

[57] ABSTRACT

Athletic shoes, especially soccer shoes are known comprising a tread sole of rubber or another material having rubber-elastic properties, which sole is provided at least partially with nubs uniformly distributed over the tread and forming a unit with the tread sole, the longitudinal axes of these nubs being aligned obliquely with respect to the sole surface. In order to broaden the area of usage of such athletic shoes, especially to render such athletic shoes suitable for sports on artificial grass or on hard courts, the obliquely oriented nubs are arranged exclusively in the areas of the ball of the foot, the ankle joint, and the heel along the rim of the sole as the outermost nub row or as external nub rows. The nubs located in the marginal zone of the tip of the sole are arranged with their longitudinal axes at least almost perpendicular with respect to the sole tread and exhibit a lower profile height than the obliquely oriented nubs. Expansion grooves extending up into the marginal zone of the tip of the sole are arranged in the forward area of the sole starting approximately from the ankle joint, in order to impart to the tread sole of such athletic shoes an increased flexibility transversely over the tread sole surface.

22 Claims, 5 Drawing Figures

TREAD SOLE FOR ATHLETIC SHOE CONSISTING OF RUBBER OR ANOTHER MATERIAL HAVING RUBBER-ELASTIC PROPERTIES

BACKGROUND AND SUMMARY OF THE INVENTION

The invention relates to a tread sole for athletic shoes consisting of rubber or another material having rubber-elastic properties. More particularly to soles having nubs uniformly distributed over the tread and oriented obliquely to the surface of the sole.

Tread soles of this type have been known, for example, from DOS (German Unexamined Laid-Open Application) No. 2,828,561. Sport shoes having such tread soles have also proven themselves best under the difficult, changing terrain conditions as in marathon or cross-country footraces.

The invention is based on the object of even further broadening the usage area for athletic footwear having tread soles of the aforedescribed type. In particular, athletic shoes with the tread sole according to this invention are to be suited for sports conducted on artificial grass or snow- and ice-covered hard courts.

This object has been attained according to the invention by a combination of features including obliquely oriented nubs being arranged exclusively as an outer row or rows in zones of the ball of the foot ankle joint and heel; shorter perpendicular nubs in a marginal tip zone; and expansion grooves a frontal region.

The obliquely oriented nubs provided along the rim of the sole in the areas of the ball of the foot, the ankle joint, and the heel ensure secure anchorage against lateral slipping. This nonslip property is still further enhanced by the feature that the tread sole exhibits increased flexibility transversely across the surface of the tread sole, due to the expansion groove or expansion grooves, so that the nubs arranged in the marginal zone of the sole can be fully effective even in case of a non-planar ground surface or when the foot strikes the ground obliquely. In particular, it is ensured that the obliquely oriented nubs in the marginal sole zone of the tread sole, on account of the greater profile height, will grip the ground first and immediately, but due to the high deformability of these nubs, also the adjacent, uninclined nubs in the marginal zone of the tread sole will come very quickly and effectively in gripping contact with the ground. As a consequence, sufficient ground contact and thus adequate nonskid behavior are ensured even in case of extreme ground conditions and difficult phases of the athletic activity.

These and other objects, features and advantages of the present invention will become more apparent from the following description when taken in connection with the accompanying drawings.

DETAILED DESCRIPTION OF THE PREFERRED EMBODIMENT

The tread sole according to the invention is denoted by 1 and consists of the zone S of the tip (toe) of the sole, representing, together with the zone B of the ball of the foot the forward sole region VS. The ankle joint zone is denoted by G and further heel zone by F. The latter consists of the relatively narrow heel zone or the actual region of the heel of the shoe, denoted by E, and the heel protection part D, which is bent slightly upwardly in a conventional way.

The forward sole region VS has, in its middle or central portion Z, a series of frustoconical nubs 2 having a height of about 4–6 mm and a basis diameter of 7–9 mm. The end face or ground-contacting side of the nubs 2 has a diameter of about 3 mm. This group of nubs is encompassed by expansion grooves *3a, 3b,* which are preferably joined to form a continuous expansion groove 3, and by the ribs 5 and 6 which bound the expansion groove 3 on respective sides and are arranged approximately perpendicularly to the sole tread surface 4.

Figure 2:
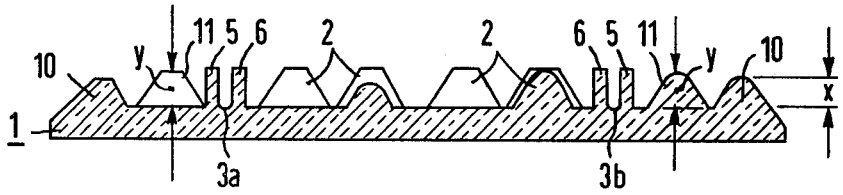
FIG. 2 shows a cross section through the tread sole taken along the section line II—II of FIG. 1.
Figure 3:
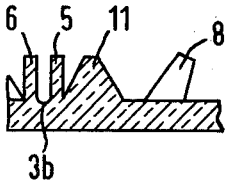
FIG. 3 shows a partial cross section through the tread sole along the section line III—III of FIG. 1.

The expansion groove 3, in the region of which the thickness of the sole is somewhat reduced as compared with the remaining sole material (see FIGS. 2 and 3), may consist—as indicated in the example—of a closed curve, for example an oval. However, the groove also can be formed from one or several juxtaposed, linear or slightly curved channels *3a, 3b,* extending approximately in the direction of the longitudinal sole axis 7 or in correspondence with the rim R of the sole and, starting approximately at the forward end of the ankle joint G, and extending up into the rim of the toe region S of the sole. Although the sole is somewhat weakened by the expansion groove 3 or the expansion grooves *3a, 3b,* this weakening is within permissible limits. On the other hand, however, the flexibility of the tread sole in the transverse direction is thereby increased to a quite considerable extent so that the obliquely oriented nubs 8 located at the rim of the sole R, and the nubs 9 arranged perpendicularly to the sole tread 4, grip the ground excellently even in case of a relatively greatly inclined position of the athlete or in case of uneven terrain, and moreover enlarge the contact area between shoe and ground.

Figure 1:
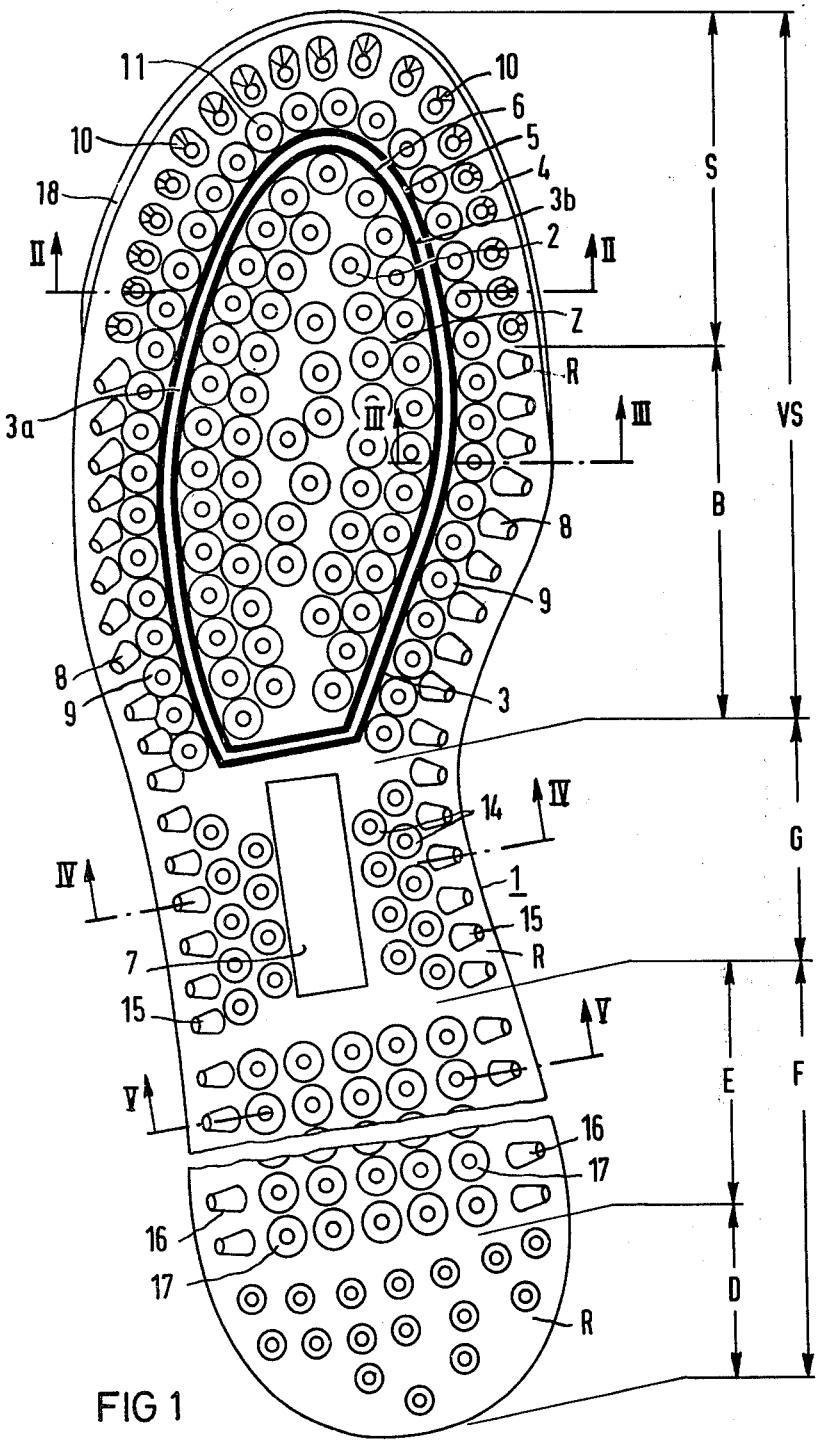
FIG. 1 shows a plan view of the bottom of the tread sole according to this invention.

According to the example shown in FIG. 1, the expansion groove 3 is surrounded by the obliquely outwardly oriented nubs 8 and by another row of nubs 9 oriented with their longitudinal axes perpendicularly or at least almost perpendicularly to the surface 4 of the tread sole. It is also possible to arrange the expansion groove 3 directly behind the nub row 8 or also behind two of these nub rows with obliquely oriented nubs 8. It is likewise possible to surround the expansion groove 3 with two nub rows having straight-oriented nubs 9 and by one nub row having obliquely oriented nubs 8.

The axes of the marginal nubs 10 provided in the region S of the tip of the sole are not inclined but rather stand essentially vertically on the sole tread 4. To avoid troublesome effects, such as stumbling edges, on account of the outermost marginal nubs 10 when playing ball or using some other kind of athletic equipment, and to ensure in spite thereof an adequate nonskid quality even in the outermost toe zone of the tread sole 1, the flanks of the outermost marginal nubs 10 aligned toward the rim of the sole are made to be less steep than the opposed, inner nub flanks. The outermost marginal nubs 10 thus pass over almost fluidly into the upwardly extended toe protection 18 of the tread sole 1, with the formation of an oval basis (basal surface). The height x of the marginal nubs 10 preferably amounts to about 4 mm, whereas the inner nubs 11 in the sole tip zone S, which are not likewise inclined, have a height y of about 5–6 mm.

The ribs 5 and 6 delimiting the expansion groove 3 or grooves 3*a*, 3*b* and the nubs 2 surrounded by these ribs in the central portion Z of the tread sole area of the same height y as the nubs 11 and optionally also as the marginal nubs 10. The spacing of the two ribs 5, 6 and thus the groove width of the expansion groove 3 can preferably amount to 1.5–2 mm.

The central nubs 2 and the nubs 9 provided outside of the expansion groove 3 in the zone B of the ball of the foot correspond in size and in configuration to the corresponding nubs 2, 11 in the sole tip zone S. The nubs 8 in the ball zone B, oriented obliquely outwardly toward the rim R of the sole have a profile height which is larger by 1–2 L mm than that of the adjoining nubs 9, i.e., they have a height of preferably 5–7 mm.

Figure 4:
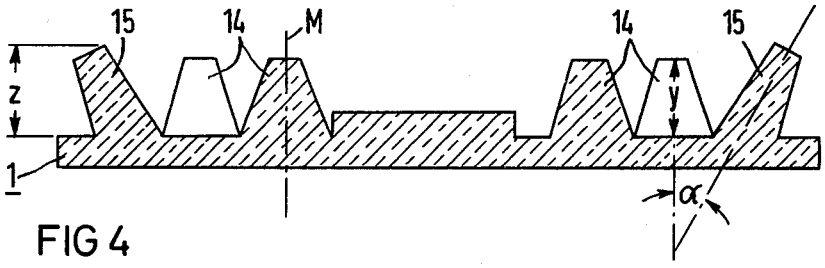
FIG. 4 shows a cross section through the ankle-joint part of the tread sole along the section line IV—IV of FIG. 1.
Figure 5:
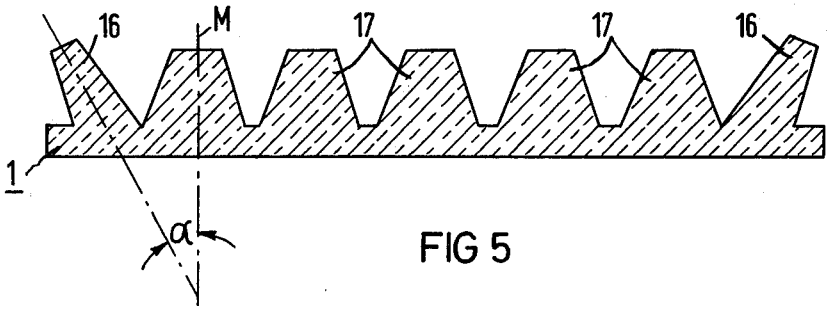
FIG. 5 shows a cross section through the heel zone of the tread sole along the section line V—V of FIG. 1.

In the ankle zone G, respectively two parallel rows of uninclined nubs 14 are arranged at mutual spacings on both sides of the longitudinal axis 7 of the sole and have a height y (FIG. 4) of about 5–6 mm. The oblique marginal nubs 15 in this zone are somewhat elevated with respect to the forward marginal nubs 8 and have a height Z of preferably about 7–8 mm and are of a somewhat more slender configuration than the forward marginal nubs 8 (basal diameter about 6 mm as compared with 8 mm in case of the forward marginal nubs 8).

In the narrower heel region E, the oblique marginal nubs 16 and the nubs 17, which are surrounded by the nubs 16 and are arranged in rows and at right angles to the tread surface 4 of the sole, are fashioned to be somewhat more rugged than the aforementioned nubs. The oblique marginal nubs 16 have a height of about 8–9 mm, and a basal diameter of about 7–8 mm, while their smaller tip diameter at their free end face is about 2 mm.

The nubs 17 arranged at least approximately perpendicularly with respect to the sole tread surface 4 have, in contrast to the above, a basal diameter of about 9 mm and a height of about 7 mm, while the end face of these nubs exhibits a diameter of about 4 mm.

Thus, the nub density (number of nubs/unit of surface area) is higher in either or both of the frontal sole region VS and ankle joint zone G than in heel region Z.

Section D of the tread sole has several small nubs, as is conventional, which nubs are arranged on the end of the sole R which curves upwardly to protect the heel bone.

The axes of the obliquely oriented marginal nubs 8, 15, 16 are usually inclined only in one direction, as also shown in the illustrated embodiment, namely with respect to the central axes M of the nubs 9, 14, 17, which are not obliquely oriented. However, it is also possible to incline the axes of the obliquely oriented marginal nubs 8, 15, 16 additionally in a still further plane, namely in such a way that the marginal nubs 8 are oriented obliquely toward the narrower heel portion E and the marginal nubs 17 are oriented obliquely toward the tip S of the sole. Such a configuration is especially advantageous in view of the acceleration and braking processes taking place during athletic activities.

The angle $\alpha$ of inclination of the marginal nubs 8, 15, 16 is preferably 20°–40°, especially 30°. It is also possible to adapt the angle $\alpha$ inclination to the height of the marginal nubs 8, 15, 16 along the lines that the angle $\alpha$ of inclination becomes smaller with an increasing height of the marginal nubs, i.e., the oblique position of the nubs becomes less slanted. The nub height and the angle of inclination are preferably adapted to each other so that the inclined marginal nubs 8, 15, 16 do not project past the sole rim R at any location.

All of the nubs, including the marginal nubs, consist of highly abrasion-resistant material, especially rubber having a Shore hardness of about 65–70 degrees Shore.

Athletic shoes with the tread sole according to this invention are suitable especially for use on artificial grass surfaces and hard-frozen, iced-over, or snow-covered ground, for soccer and hockey sports. Moreover, the tread sole of this invention, however, is also suitable for all types of running sports, preferably over uneven, open terrain.

What is claimed is:

1. Tread sole for athletic shoes comprised of rubber or like material having rubber-elastic properties, said sole being provided with nubs uniformly distributed over at least a portion of the tread and forming a unit with the tread sole, some of the nubs being oriented, as a whole, obliquely to the sole surface, characterized by the combination of the following features:

(a) the obliquely oriented nubs are arranged exclusively along a rim of the sole in zones of the sole corresponding to the ball, the ankle joint, and the heel region of a foot as at least one outermost row of nubs;

(b) some of the nubs being provided in a marginal zone of the toe of the sole, said marginal zone nubs being arranged with their longitudinal axes substantially perpendicular to the sole tread and having a smaller profile height than the obliquely oriented nubs; and (c) expansion grooves being located in a frontal region of the sole starting approximately from the zone of the ankle joint and extending forwardly up into the marginal zone of the toe of the sole.

2. Tread sole according to claim 1, characterized in that the expansion grooves extend approximately in parallel to the contour of the rim of the sole in the frontal region zone of the sole and are connected so as to form a continuous groove surrounding a central part of the frontal region in the form of an at least approximately oval-shaped, closed contour.

3. Tread sole according to claim 1 or 2, characterized in that the expansion grooves are or is encompassed by at least two continuous nub rows.

4. Tread sole according to claim 3, characterized in that the expansion grooves are bounded by ribs extending substantially perpendicularly to the sole surface.

5. Tread sole according to claim 4, wherein some of the nubs in the frontal region are not obliquely oriented, and characterized in that the ribs which bound the expansion grooves are approximately the same height as the nubs located in the frontal region which are not obliquely oriented.

6. Tread sole according to claims 1 or 2, wherein some of the nubs in the heel region, frontal region and ankle zone are not obliquely oriented, and characterized in that the height of those of the nubs located in at least one of the frontal region and ankle joint zone which are not obliquely oriented is lower than the height of those of the nubs located in the heel region which are not obliquely oriented.

7. Tread sole according to claim 3, wherein some of the nubs in the heel region, frontal region and ankle zone are not obliquely oriented, and characterized in that the height of those of the nubs located in at least one of the frontal region and ankle joint zone which are not obliquely oriented is lower than the height of those of the nubs located in the heel region which are not obliquely oriented.

8. Tread sole according to claim 5, wherein some of the nubs in the heel region, frontal region and ankle zone are not obliquely oriented, and characterized in that the height of those nubs located in at least one of the frontal regions and ankle joint zone which are not obliquely oriented is lower than the height of those of the nubs located in the heel region which are not obliquely oriented.

9. Tread sole according to claim 1 or 2, characterized in that the nub density in the frontal sole region and/or ankle joint region (VS, G) is higher than the nub density in the heel region (E).

10. Tread sole according to claim 8, characterized in that the nub density in the frontal sole region and/or ankle joint region (VS, G) is higher than the nub density in the heel region (E).

11. Tread sole according to claim 1 or 2, characterized in that the obliquely oriented nubs along the rim of the sole in the heel region have a larger profile height than the nubs along the rim of the sole in at least one of the ball and the ankle joint zones.

12. Tread sole according to claim 10, characterized in that the obliquely oriented nubs along the rim of the sole in the heel region have a larger profile height than the nubs along the rim of the sole in at least one of the ball and the ankle joint zones.

13. Tread sole according to claim 1 or 2, characterized in that nubs which are not obliquely oriented are located in the frontal sole region, ankle joint and heel regions and are formed in the shape of a truncated cone.

14. Tread sole according to claim 12, characterized in that nubs which are not obliquely oriented are located in the frontal sole region, ankle joint and heel regions and are formed in the shape of a truncated cone.

15. Tread sole according to claim 1 or 2, characterized in that all of the nubs of the tread sole are formed of a highly abrasion-resistant material, having a Shore hardness of about 65–70 degrees Shore.

16. Tread sole according to claim 14, characterized in that all of the nubs of the tread sole are formed of a highly abrasion-resistant material, having a Shore hardness of about 65–70 degrees Shore.

17. Tread sole according to claim 1 or 2, characterized in that the obliquely oriented nubs arranged along the sole rim are oriented obliquely laterally toward the outside and extend approximately up to the rim of the sole.

18. Tread sole according to claim 11, characterized in that the obliquely oriented nubs in the frontal sole region are oriented not only obliquely laterally toward the outside to the rim of the sole, but at the same time are oriented obliquely rearward toward the heel region.

19. Tread sole according to claim 11, characterized in that those of the obliquely oriented nubs located in the heel region are oriented not only obliquely laterally toward the outside to the rim of the sole, but simultaneously obliquely forward toward the region of the tip of the sole.

20. Tread sole according to claim 16, characterized in that the obliquely oriented nubs arranged along the sole rim are oriented obliquely laterally toward the outside and extend approximately up to the rim of the sole.

21. Tread sole according to claim 20, characterized in that the obliquely oriented nubs in the frontal sole region are oriented not only obliquely laterally toward the outside to the rim of the sole, but at the same time are oriented obliquely rearward toward the heel region.

22. Tread sole according to claim 20, characterized in that those of the obliquely oriented nubs located in the heel region are oriented not only obliquely laterally toward the outside to the rim of the sole, but simultaneously obliquely forward toward the region of the tip of the sole.

* * * * *